US005489062A

United States Patent [19]

Wagner et al.

[11] Patent Number: 5,489,062

[45] Date of Patent: Feb. 6, 1996

[54] FOLDABLE PACKAGING CONTAINER

[75] Inventors: Engelbert Wagner; Clemens Höpp, both of Radolfzell, Germany

[73] Assignee: Meurer Druck & Carton GmbH, Germany

[21] Appl. No.: 187,094

[22] Filed: Jan. 26, 1994

[30] Foreign Application Priority Data

Feb. 3, 1993 [DE] Germany ..... 43 03 041.6

[51] Int. Cl.[6] ..... B65D 5/46

[52] U.S. Cl. ..... 229/117.18; 229/120.011

[58] Field of Search ..... 229/120.17, 120.011, 229/120.01, 245, 117.12, 117.18

[56] References Cited

U.S. PATENT DOCUMENTS

| | | | |
|---|---|---|---|
| 2,591,548 | 4/1952 | Inman | 229/120.17 |
| 2,743,050 | 4/1956 | Crane | 229/120.17 X |
| 3,021,001 | 2/1962 | Donefrio | 229/120.011 X |
| 3,983,999 | 10/1976 | Morton | 229/120.011 |
| 4,202,465 | 5/1980 | McLaren | 229/120.17 X |
| 4,228,945 | 10/1980 | Wysocki | 229/120.17 X |
| 4,241,863 | 12/1980 | Faller | 229/120.17 X |
| 4,944,451 | 7/1990 | Forbes, Jr. | 229/120.17 |
| 5,009,363 | 4/1991 | Zavotone | 229/120.17 |

*Primary Examiner*—Allan N. Shoap
*Assistant Examiner*—Christopher J. McDonald

[57] ABSTRACT

A foldable packaging container which is cut from a web of material, in particular a sheet of cardboard, has a bottom panel (14) and transverse and end walls (18, 16) which extend therefrom and which are separated therefrom by bend lines (24, 26) or the like weakening lines. The transverse and end walls are folded up at an angle relative to the bottom panel (14) to form a frame means surrounding same, for a receiving space (36), wherein each two transverse walls (18) of respective adjacent packaging containers, as part of the web of material, are separated by a bending line (22).

14 Claims, 4 Drawing Sheets

FOLDABLE PACKAGING CONTAINER

Figures 1, 2, 3:
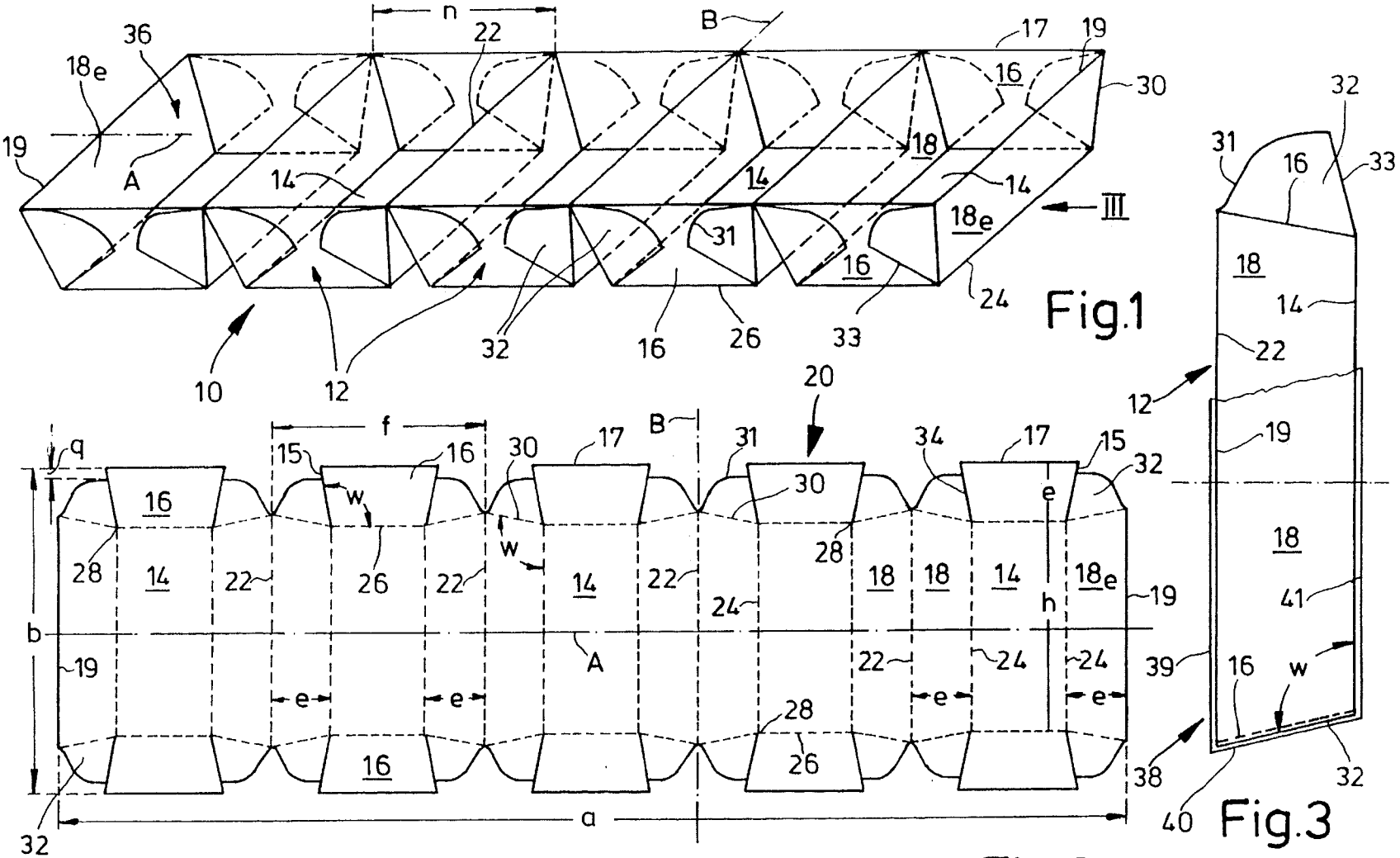

The invention concerns a foldable packaging container having a bottom panel and extending therefrom transverse and end walls, in particular for foodstuffs such as chocolate bars, confectionery or the like.

In the course of reducing the amounts of packaging used, the endeavour is increasingly that of replacing the containers made of plastic material and foil, which in themselves have hitherto become the conventional practice, by containers made from pure paper or cardboard material, while to reduce transportation capacities the aim is to supply the packaging company with flat blanks which the packaging company then puts into the definitive form of packaging and fills same.

In consideration of those facts the inventor set himself the aim of providing a foldable packaging container of the kind set forth in the opening part of this specification, which both complies with the requirements in regard to good recyclability and is also inexpensive and helps to save on packaging material. The packaging container is to be environmentally friendly, simple to dispose of and variable in regard to configuration and usability.

That object is attained by a packaging container and a blank intended for same, as set forth in the independent claims; the appendant claims set forth further advantageous embodiments.

In accordance with the invention the packaging container includes a bottom panel and transverse and end walls which extend therefrom and which are separated therefrom by bend lines, made from a web of material, in particular a sheet of paper and cardboard; the transverse and end walls of the packaging container are folded up at an angle relative to the bottom panel in order to form a frame means surrounding same, for a receiving space, wherein two transverse walls of adjacent packaging containers are respectively part of the web of material and are separated by a bending line. That arrangement affords a form of container which is reminiscent of over-sized chocolate bars as a plurality of individual containers—which are produced jointly from a single sheet of cardboard—are linked together as a packaging unit and can be jointly filled and handled.

In accordance with a further feature of the invention therefore the described packaging container, as an individual container, is part of a packaging box structure which is extended in a chocolate bar-like configuration, wherein the individual containers are separated from each other by the bending lines of the web of material and the adjacent transverse walls of each to individual containers can be moved relative to each other about a structural hinge axis which is defined by the bending line. That is made possible by virtue of the fact that the adjacent pairs of transverse walls each define a respective wedge-shaped space beneath the bending line with an aperture angle which is preferably between 5° and 30°. Such an angle of 20° has been found to be particularly desirable.

The packaging box structure according to the invention, comprising a plurality of individual containers which are arranged in a row with each other and which are linked together, in that fashion, satisfies the object specified by the inventor and can be produced in almost any length with one blank.

As a result of the wedge-shaped spaces provided between the transverse walls of the individual containers, in the position of use in which they are aligned, the packaging box structures according to the invention can assume a different configuration, that is to say the end walls thereof can be associated with each other in curved contours similarly to a caterpillar tractor-type track. However it has been found advantageous for the .packaging box structure which comprises a plurality of individual containers to be filled, closed and transported in the form of a flat bar configuration.

As a closure means, in accordance with the invention, it is possible to use a separate cover panel which in turn is produced from a cardboard blank and which is provided with edge or side strip portions for connecting it to the packaging box structure. It is equally possible however to provide on an end transverse wall—possibly also on both—a cover tongue portion which is separated from said transverse wall by an embossing line and which can be laid around same on to the individual containers. As the latter can be separated from each other at the described bending lines of the transverse walls—in the above-mentioned fashion of chocolate bars, it has also been found desirable for the cover tongue portion or portions to be provided with corresponding perforation lines. That gives rise to a packaging box structure of elongate configuration, which can be reduced in length in stages or steps as desired.

As the packaging box structure according to the invention can be folded over in the region of each bending line between two adjacent transverse walls, it is also possible for the row of individual containers to be folded over on to each other in two parts, for example at the longitudinal center of the packaging box structure, and thus to put the structure in the closed position. Before the packaging box structure is folded over in that way, the individual receiving spaces can possibly be closed for example by a sheet of cardboard—or a transparent foil—and the two parts can then be connected in the region of their upper edges.

An aspect of particular significance is the proposal according to the invention that a packaging box structure of that kind comprising individual containers which lie one upon the other in pairs is to be provided with at least one projecting holding flap portion by virtue of which the entire unit can be readily mounted on a sales stand or the like.

A further possible form of use of the packaging box structure according to the invention is the use of a protective casing or enclosure which in turn is also made from cardboard and which is pushed on to the packaging box structure and which in addition makes it possible for individual containers which lie one upon the other in pairs in the above-described manner to be held together and protected.

Overall there is provided a container which can be used in a wide range of different ways and which comprises a material which is easy to dispose of, the container being simple to manufacture, low in weight for transportation and easy to put into its condition of use. In comparison with other forms of packaging this arrangement involves an astonishingly high saving in terms of packaging material.

The present invention embraces not only the described various forms of the packaging box structure or the interlinked individual containers, but also the blank which is required therefor and for which protection is claimed separately. In that respect various kinds of weakening lines such as perforations, scoring/counter-scoring, embossing lines or the like are used in order to define the individual areas or portions of the blank.

Figures 4, 5, 6:
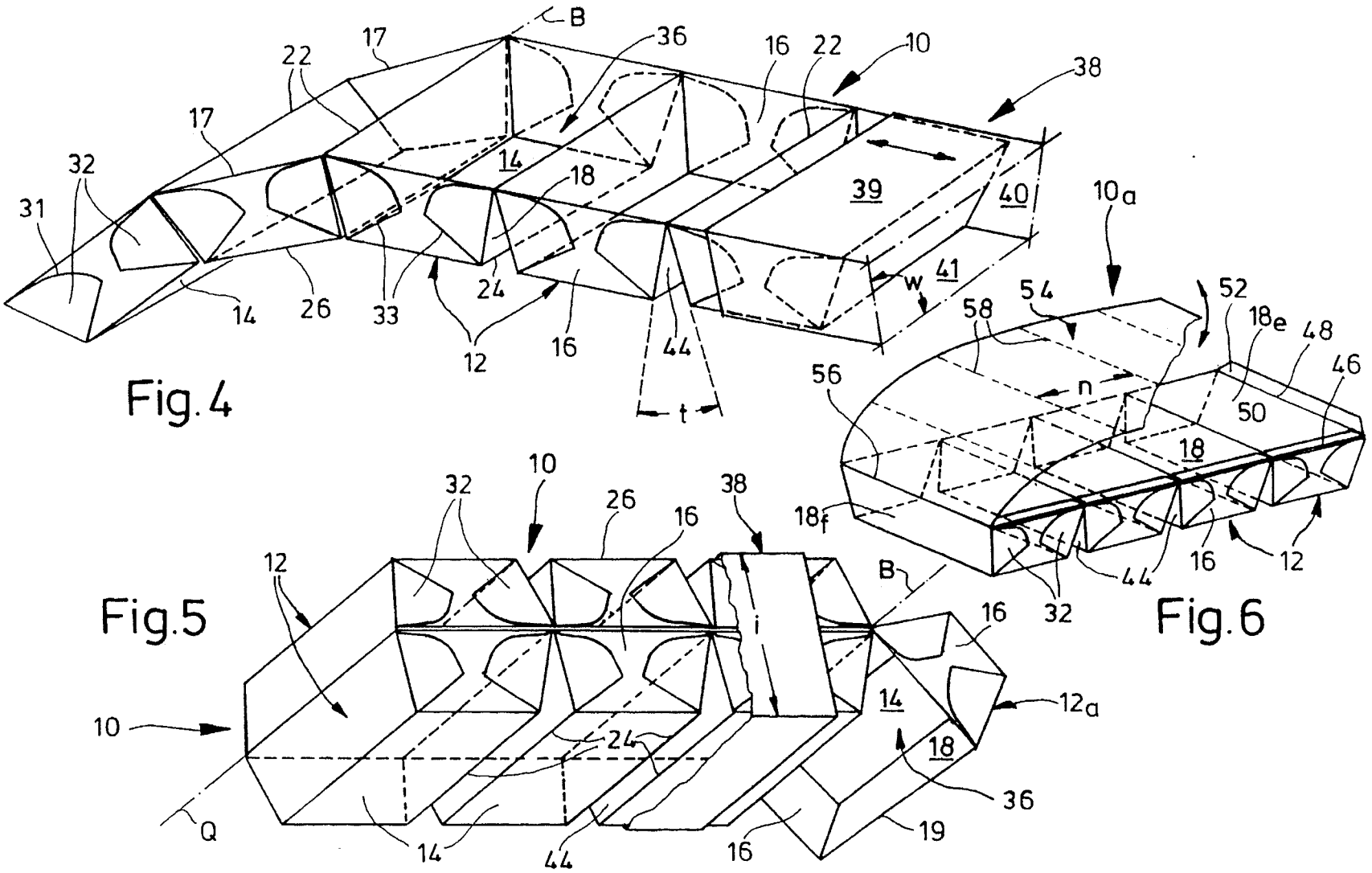
Figure 7:
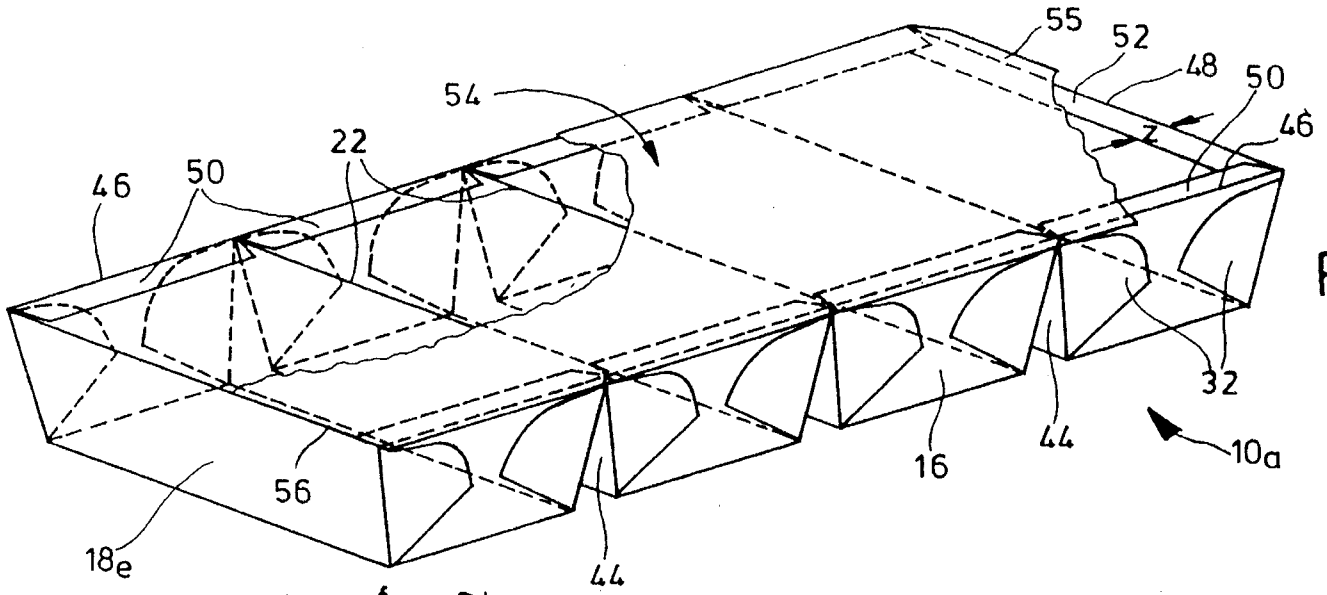
Figure 8:
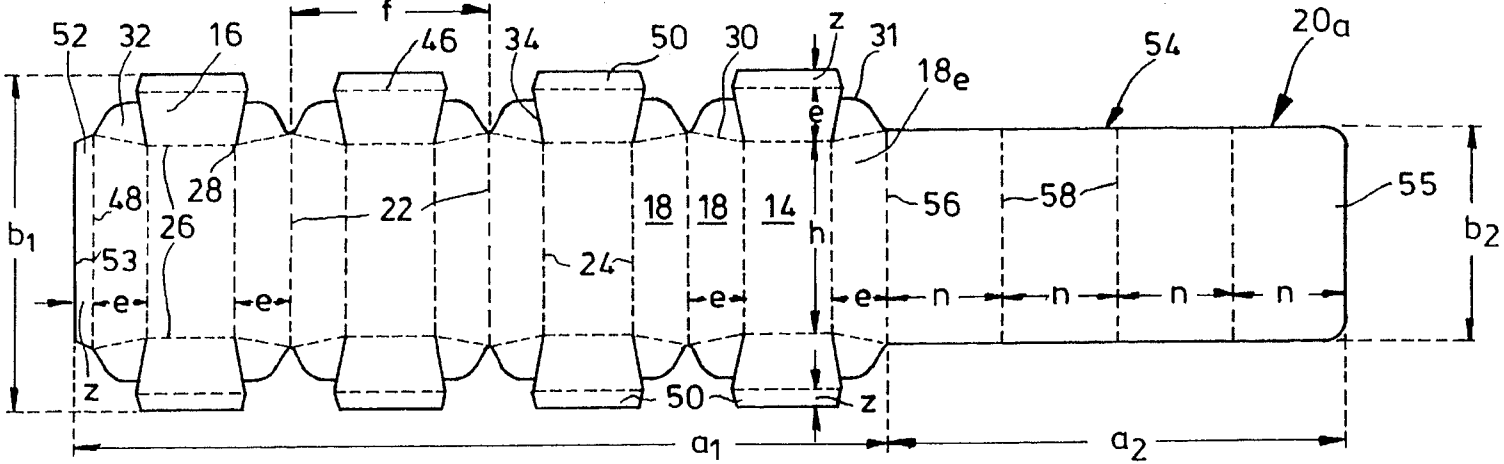
Figure 10:
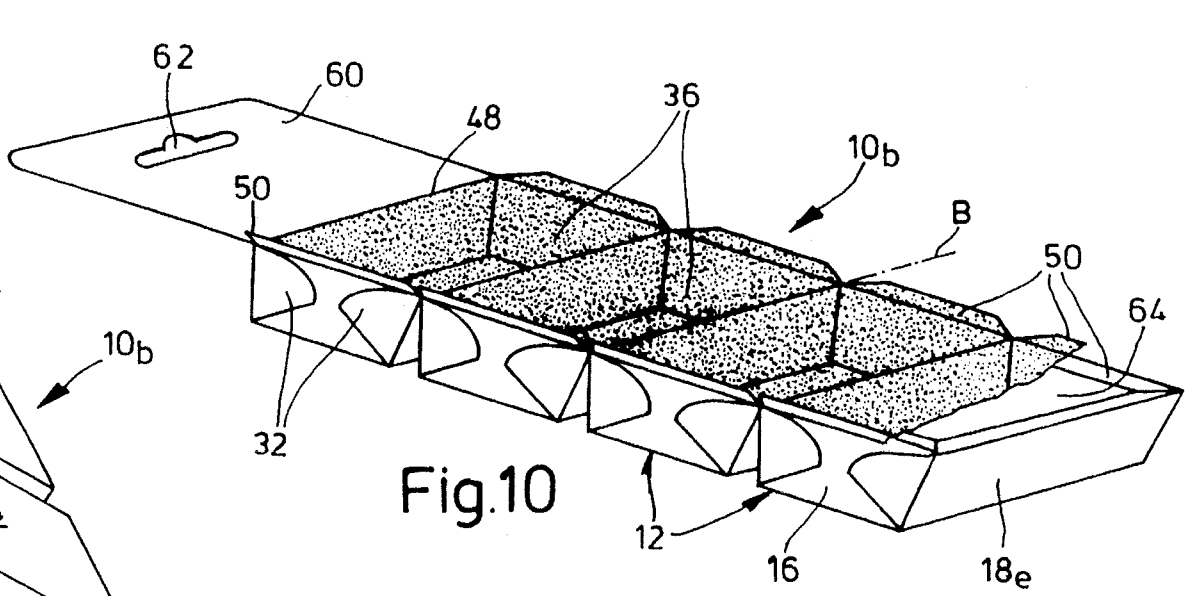
Figure 11:
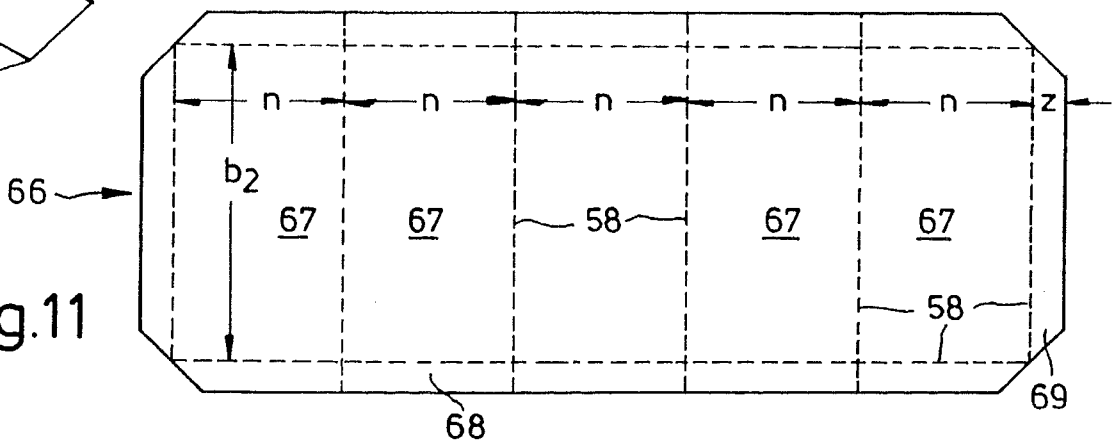
Figure 9:
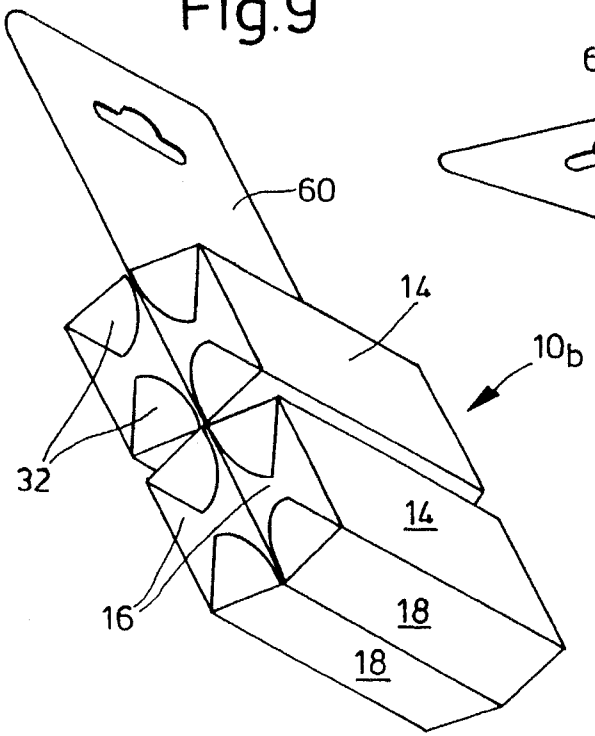

Further advantages, features and details of the invention will be apparent from the following description of preferred embodiments and with reference to the drawing in which:

FIG. 1 is a perspective view on to an open packaging box structure comprising a plurality of interlinked individual containers, FIG. 2 is a plan view of the blank for FIG. 1, FIG. 3 is a partly sectional front view on an enlarged scale of the packaging box structure as viewing along the line of arrow III in FIG. 1, with a partially indicated protective casing, FIG. 4 is a perspective view of the packaging box structure which is partially surrounded by the protective casing, FIG. 5 is a perspective view of another configuration of the packaging box structure, FIG. 6 is a perspective view of a further embodiment of the packaging box structure with the cover tongue portion raised, FIG. 7 is a perspective view of a packaging box structure similar to the configuration shown in FIG. 6, with the applied cover tongue portion being partially shown, FIG. 8 is a plan view of the blank for FIGS. 6 and 7, on a reduced scale, FIG. 9 is a perspective view of a packaging box structure according to the invention, which is provided with a suspension flap portion, FIG. 10 is a perspective view of the embodiment of the packaging box structure shown in FIG. 9, in the opened condition, and FIG. 11 is a plan view of another detail of a packaging box structure according to the invention.

Referring to FIG. 1, a packaging box structure 10 of cardboard of a thickness of about 0.5 mm—for example for confectionery—has five individual containers 12 which are joined in a line and each of which comprises a bottom panel 14, two end walls 16 and two transverse walls 18 connecting the latter. The cross-sections of the individual containers 12 decrease from the upper edges of the walls towards the bottom panel 14, both parallel to the longitudinal axis A of the packaging box structure 10 and also transversely thereto. The angle w between the bottom panel 14 and the end walls 16 and the transverse walls 18 respectively is somewhat more than 100°.

As can be seen in FIG. 2 in particular in relation to the blank 20 for the packaging box structure 10, the respectively adjacent transverse walls 18 of two individual containers 12 are separated by a bending line 22 which forms a kind of hinge axis between the individual containers 12; they can be pivoted towards each other about the hinge axis which is clearly indicated by B in FIGS. 1 and 2. In addition, for the sake of enhanced clarity of the drawing, the upper edges of the outer transverse walls **18*e* of the packaging box structure 10 are denoted by reference numeral 19 while the upper edges of the end walls 16 are denoted by reference numeral 17**.

The length a of the blank 20, which is determined by the upper edges 19 of the outer transverse walls 18, measures 450 mm while its width b is here 140 mm; that is at the same time the spacing of the upper edges 17 of the end walls 16 from each other. Two parallel bend lines 24 extend at a spacing e of 25 mm in each case relative to the bend lines 22 and the upper edges 19 which cross the longitudinal axis A—in each panel portion of the width f of the blank of 90 mm for the individual container 12. The transverse walls 18 can be erected towards the bottom panel 14 about the two parallel bend lines 24. In parallel relationship with the longitudinal axis A, the bottom panel 14 is delimited by bend lines 26 which are arranged at a spacing h from each other of about 90 mm and outwardly adjoined by the end walls 16 of a height e.

Extending from the points of intersection 28 of the bend lines 26, 24 are flap lines 30 which are inclined at an angle w relative to the bend lines 24 of the transverse walls 18 and which at the other end terminate at the upper edge 19 of the outer transverse walls 18 and structurally separate same from flap portions 32. Separating lines 34 are cut in the material between the flap portions 32 and the end walls 16.

In FIG. 3 the intersection edge of the flap portion 32, which edge is produced by the separating line 34 and is joined to the end of the upper edge 19 or the bending line 22 by a curved cut edge 31, is identified by reference numeral 33. While the length of the side edges 15 of the end walls 16, which edges 15 are inclined at an angle w relative to the bend line 26, corresponds to the length of the flap lines 30 which are also inclined, the above-mentioned lateral cut edge 33 of the flap portion 32 is shorter by the differential dimension q (at the left in FIG. 2).

The blank 20 is stamped out of a sheet of cardboard which is not particularly shown here, and then the end walls 16 are folded out of the plane of the bottom panel 14 about the bend lines 26 and the transverse walls 18, 18e are folded out of the plane of the bottom panel about their bend lines 24, the transverse walls 18 being folded about their bending lines 22. The flap portions 32 which project from the lateral ends of the transverse walls 18 are then brought into position against the end walls 16 from the outside by pivoting about the flap lines 30, and are glued to the end walls 16. That results in the strip of containers shown in FIG. 1 with for example five receiving spaces 36 for material to be packaged, which is not shown in the drawing.

The described packaging box structure 10 can be fitted into a protective casing or enclosure 38 which is suited thereto in terms of cross-section. The protective casing 38 is only indicated in FIG. 3 and the cover panel portion 39 thereof extends over the receiving spaces 36. Adjoining the cover panel portion 39 at both sides are casing walls 40 which are connected by means of a casing bottom 41.

The packaging box structure 10 is pushed into the protective casing 38 in the direction of the longitudinal axis A, in which respect it can be seen from FIG. 4 that the individual containers 12, while outside the protective casing 38, can be pivoted towards each other about the hinge axes B or the bending lines 22, more specifically until the outside surfaces of the transverse walls 18 bear against each other. When the upper edges 17 of the end walls 16 are disposed in one plane, wedge-shaped spaces 44 which are of a triangular configuration in cross-section are defined between the transverse walls 18 of the individual containers 12 beneath the bending lines 22 thereof. The aperture angle t of the wedge-shaped spaces 44 measures about 20°.

It is also possible for the packaging box structure 10 to be folded about one of its bending lines—Q in FIG. 5—in such a way as to result in a double pack which is held together by a protective casing or enclosure 38—of correspondingly doubled height i. In addition, FIG. 5 indicates, at the right-hand end of the packaging box structure 10, that a superfluous individual container **12*a*** can be cut off along the hinge axis B.

In the embodiment of a packaging box structure **10*a* shown in FIG. 6, the upper edges of the end walls 16 and an outer transverse wall 18*e* are formed by fold lines 46, 48 about which wall flap portions 50, 52 of the end and transverse walls 16 and 18 respectively can be pivoted. They are then joined for example by adhesive to a flap cover or a cover tongue portion 54 which is fixed to an end transverse wall 18*f* and separated therefrom by an embossing line 56. In addition to the embossing line 56, mutually parallel perforation lines 58 may be provided in the cover tongue portion 54; the spacings n of the mutually parallel perforation lines 58 correspond to the spacings of the bending lines 22 in the finished packaging box structure 10 or 10*a*. In the closed condition of the packaging box structure 10*a*, as shown in FIG. 7, the free end of the cover tongue portion 54 projects beyond the end transverse wall 18*e*, as a gripping strip portion 55**.

The length a1 of the blank 20*a* between the free edge 53 of the wall flap portion 52 with the embossing line 56 is in this case 370 mm, including the flap portion width z of 10 mm, while the length a2 of the cover tongue portion 54 is here 207 mm. The width b1 of the blank 20*a* measures about 156 mm, the width b2 of the cover tongue portion 54 is only 110 mm but the spacing n between the perforation line 58 thereof is 52

FIGS. 9 and 10 clearly show a packaging box structure 10 which can be hung up in sales racks or stands or the like by means of a projecting flap portion 60 with transverse slot 62. The projecting flap portion 60 here replaces the wall flap portion of an end transverse wall 18*e* and is separated from same by the fold line 48. To close the packaging box structure 10*b*, two of the individual containers 12 are pivoted about the notional hinge axis B, possibly after the fitting of a taut transparent foil 64, as is indicated at the right in FIG. 10.

For a simple design configuration, the packaging box structure 10 can have a cover panel 66 glued over same, the cover panel 66 being subdivided by perforation lines 58 into a plurality of cover portions 67, each of which covers over an individual container 12. In the covering position the cover panel 66 engages with end flap portions 68, 69 over the upper regions of the end and transverse walls 16, 18.

We claim:

1. A foldable packaging container comprising a bottom panel (14) and transverse and end walls (18, 16) which extend from the bottom panel and which are separated therefrom by bend lines (24, 26), the container being cut from a sheet of material, the longitudinal axis of the said sheet crossing a plurality of bending lines which respectively extend across a width of the sheet and separate adjacent portions of the sheet into respective individual containers, the bending lines at each side of the respective containers being disposed at a spacing of a height of the transverse wall with respect to the respective bend lines adjoining the respective bottom panes, the transverse and end walls of the container being folded up at an angle relative to the bottom panel (14) to form a frame means for surrounding the bottom panel (14) and for forming a receiving space (36), wherein each two transverse walls (18) of adjacent packaging containers are separated as part of the sheet of material by a bending line (22), and whereby a plurality of individual containers of the same form are formed into a packaging box structure which is extended in a bar-like configuration having a width equal to a width of the individual containers and a width of the bending lines (22), the sheet further including a projecting flap portion (60) which is connected by a fold line (48) to an end transverse wall (18*e*), the projecting flap portion (6Q) including a transverse slot (62).

2. A packaging container according to claim 1 characterized in that the individual containers (12, 12*a*) are separated from each other by the bending lines (22) of the web of material and the adjacent transverse walls (18) of each two individual containers are movable relative to each other after a structural hinge axis (B) defined by the bending line.

3. A packaging container according to claim 1 characterized in that the upper edges (17, 19) of the end and transverse walls (16, 18) are disposed in one plane in the position of use and the adjacent transverse walls (18) define a wedge-shaped space (44) with an aperture angle (t).

4. A packaging container according to claim 3 characterized by an aperture angle (t) of between 5° and 30°, preferably about 20°.

5. A packaging container according to claim 1 characterized in that, in the position of use, the transverse walls (18, 18*e*, 18*f*) form with the bottom panel (14) an angle (w) of over 90°, preferably between 95° and 120°, in particular about 100°.

6. A packaging container according to claim 1 characterized in that, in the position of use, the end walls (16) form with the bottom panel (14) an angle (w) of over 90°, preferably between 95° and 120°, in particular about 100°.

7. A packaging container according to claim 1 characterized in that projecting from the transverse walls (18, 18*e*, 18*f*) at both ends are flap portions (32) which can be folded in pairs on to one of the end walls (16) and which can be fixedly joined to same.

8. A packaging container according to claim 1 characterized in that the upper edges of the end walls (16) include a fold line (48) for an adjoining wall flap portion (52) and the upper edges of the end transverse walls (18*e*) include a fold line (46) for an adjoining wall flap portion (50).

9. A packaging container according to claim 1 characterized in that adjoining an end transverse wall (18*f*) with the interposition of an embossing line (56) is a cover tongue portion (54) which in the closure position engages over a plurality of the individual containers (12, 12*a*).

10. A packaging container according to claim 1 characterized in that the individual containers (12, 12*a*) are covered over by a common cover panel (66) and same is connected to the end walls (16) and the end transverse walls (18) by edge flap portions (68, 69).

11. A packaging container according to claim 1 characterized in that it is inserted into a protective casing (38) comprising a casing bottom (41), cover panel (39) and longitudinal walls (40) connecting same.

12. A packaging container according to claim 1 characterized in that the cover means for covering the plurality of individual containers (38, 54, 66) has parallel perforation lines (58) whose spacing (n) from each other correspond to the spacings of the bending lines (22) in the position of use of the packaging box structure (10, 10*a*, 10*b*).

13. A packaging container according to claim 1 characterized in that a portion of its individual containers (12, 12*a*) is folded on to the other portion of the individual containers about one of the bending lines (22), and the upper edges (17, 19, 22) of the end and transverse walls (16, 18) lie one upon the other.

14. A packaging container according to claim 1 characterized in that at least one projecting flap portion (60) projects in a central plane defined by two rows of individual containers (12, 12*a*) which lie one upon the other and which are joined to each other.

* * * * *

UNITED STATES PATENT AND TRADEMARK OFFICE

CERTIFICATE OF CORRECTION

PATENT NO. : 5,489,062

DATED : February 6, 1996

INVENTOR(S) : Engelbert Wagner et al

It is certified that error appears in the above-identified patent and that said Letters Patent is hereby corrected as shown below:

Col. 5, line 51 change "(6Q)" to —(60)—.

Signed and Sealed this

Ninth Day of April, 1996

Bruce Lehman

BRUCE LEHMAN

*Commissioner of Patents and Trademarks*

*Attest:*

*Attesting Officer*